United States Patent [19]

Didek et al.

[11] 4,168,601

[45] Sep. 25, 1979

[54] FRICTIONAL OPEN-END SPINNING METHOD AND APPARATUS

[75] Inventors: Stanislav Didek; Ludvik Fajt; Vaclav Rohlena; Jaromir Kaŝparek, all of Usti, near Orl, Czechoslovakia

[73] Assignee: Vyzkumny ustav bavlnarsky, Usti nad Orlici

[21] Appl. No.: 882,116

[22] Filed: Feb. 28, 1978

[30] Foreign Application Priority Data

Mar. 9, 1977 [CS] Czechoslovakia ..... 1594/77
Dec. 29, 1977 [CS] Czechoslovakia ..... 8986/77

[51] Int. Cl.[2] ..... D01H 1/12
[52] U.S. Cl. ..... 57/58.95; 57/58.89
[58] Field of Search ..... 57/58.89–58.95, 57/77.4, 77.42, 156, 334, 335

[56] References Cited

U.S. PATENT DOCUMENTS

| | | | |
|---|---|---|---|
| 3,611,695 | 10/1971 | Brown | 57/58.89 |
| 3,786,622 | 1/1974 | Negishi | 57/58.89 |
| 3,913,310 | 10/1975 | Fehrer | 57/58.89 X |
| 3,972,173 | 8/1976 | Fehrer | 57/58.89 |
| 3,981,137 | 9/1976 | Fehrer | 57/58.89 X |
| 4,051,653 | 10/1977 | Mitteregger | 57/58.89 |
| 4,060,966 | 12/1977 | Konig | 57/58.89 |

*Primary Examiner*—Charles Gorenstein

[57] ABSTRACT

There is disclosed a method of and an apparatus for frictional spinning yarn on the open-end principle. Continuously supplied separated fibers are deposited onto a first, perforated frictional surface provided on a rotary carrier for conveying the fibers to the mouth of a wedge-like gap defined by said frictional surface and another, second, frictional surface provided on another rotary carrier. The second frictional surface moves relative to the first-named carrier, in the opposite direction, and with the first frictional surface twists the fibers in the mouth of said wedge-like gap to yarn, due to a contact with the two frictional surfaces. The yarn is withdrawn sidewards relative to the direction of movement of the frictional surfaces while preventing the twist propagation. In accordance with the invention one frictional surface is concave and the other is convex. This results in a number of advantages, including the elimination of undesirable slippage of the yarn in the yarn building region.

26 Claims, 19 Drawing Figures

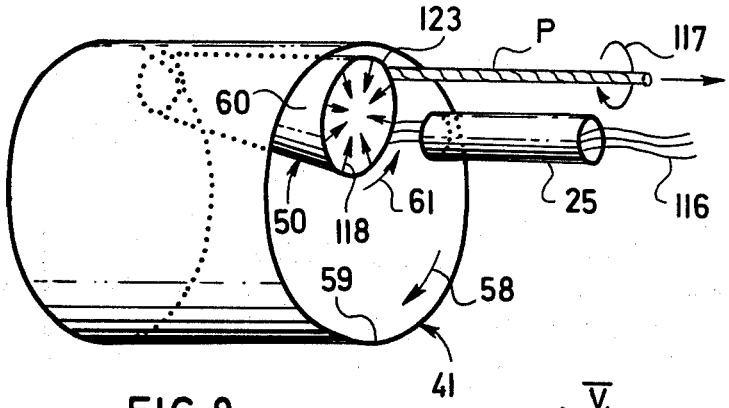
FIG.9
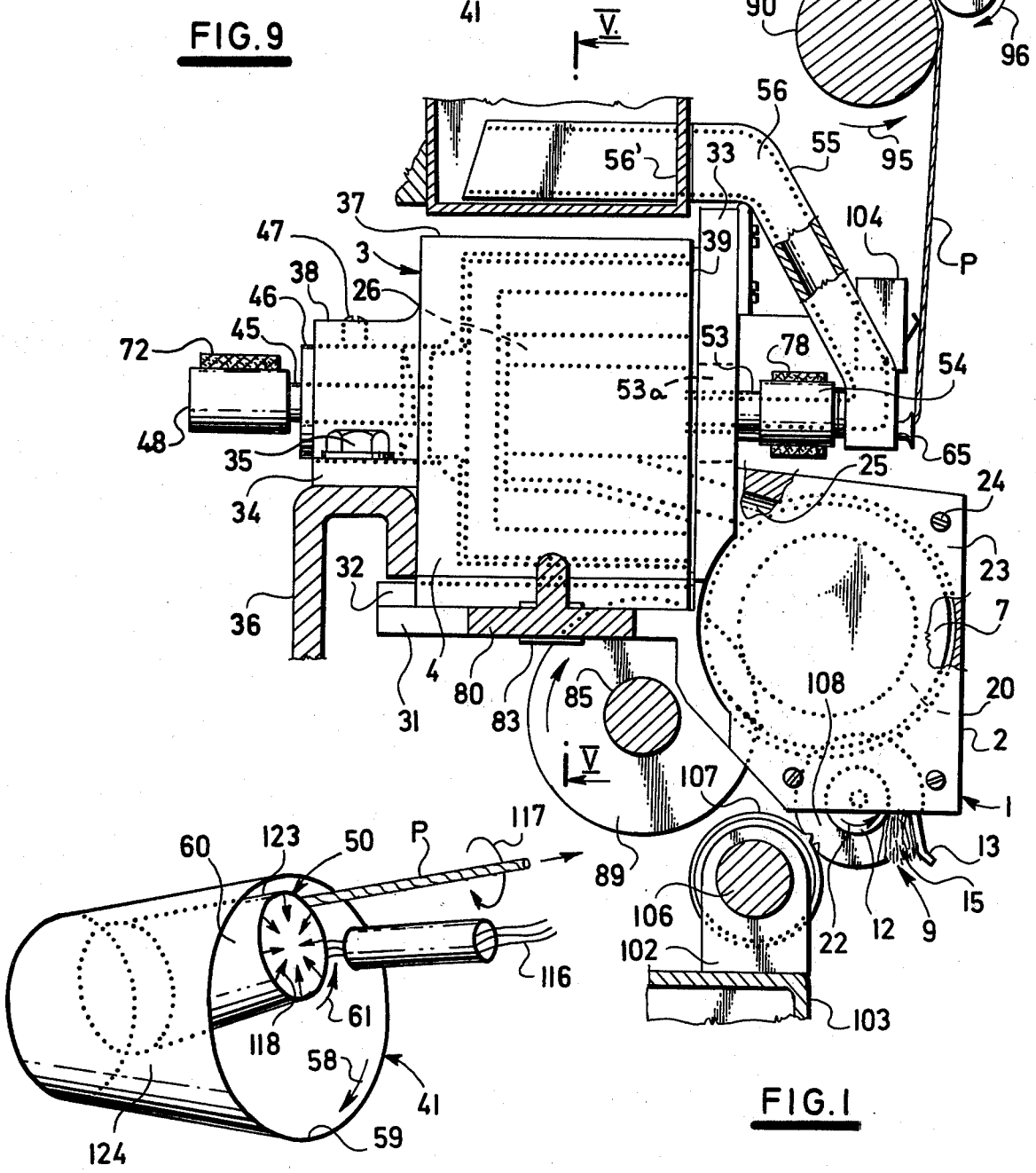
FIG.1
FIG.10

FRICTIONAL OPEN-END SPINNING METHOD AND APPARATUS

The invention relates to a method of frictional spinning yarn based upon the open-end spinning principle, comprising depositing continuously supplied separated fibers onto a frictional surface provided on a rotary carrier and designed for conveying the fibers to the mouth of a wedge-like gap defined by said frictional surface and another frictional surface provided on another rotary carrier moving in said wedge-like gap in the opposite direction relative to the first frictional surface, twisting the fibers to yarn in the mouth of said wedge-like gap, and withdrawing the yarn sidewards from the wedge-like gap while preventing the twist propagation, the improvement being in that the fibers are twisted between a convex and a concave frictional surface, as well as to an apparatus for carrying out this method, comprising a mechanism for supplying the separated fibers onto a frictional surface onto a frictional surface of a pair of frictional surfaces provided on respective rotary carriers and associated in contactless manner with each other so as to form a wedge-like gap in the mouth of which the fibers are twisted, due to friction with the two frictional surfaces moving in mutually opposite directions in said wedge-like gap, and a mechanism for taking off the yarn sidewards from the wedge-like gap, said yarn taking-off mechanism being adapted to prevent any twist propagation, the improvement being in that one frictional surface is concave and the other frictional surface is convex relative to the yarn building region in the mouth of the wedge-like gap.

In accordance with the invention one frictional surface is concave and the other is convex. This results in a number of advantages, including the elimination of undesirable slippage of the yarn in the yarn building region.

The gist of the frictional open-end spinning technique is in that separated fibers are supplied into the mouth of a wedge-like gap provided between two counterdirectionally moving frictional surfaces. The continuously supplied fibers in this space wrap onto a rolling open end of yarn which is withdrawn in a direction perpendicular to the direction of movement of said frictional surfaces.

Thus, for instance, a frictional open-end spinning method, now to be described, is known wherein fibers are supplied into a wedge-like gap provided between a pair of parallel sucking drums which are associated with each other in a close but contactless relationship and are arranged to rotate in the same direction. On the drums there are provided perforated sucking zones which face each other in said wedge-like gap region.

By twisting continuously supplied fibers in said gap and wrapping them onto the so-called open-end being formed in said gap there is formed yarn which is continuously withdrawn by a pair of take-off rollers which simultaneously prevent any further twist propagation.

The perforated walls of the sucking drums, which are in the form of rolls, forming the operation frictional surfaces form a wedge-like gap widely opening from the line of closest approach of the rolls to each other. Since the two drums or rolls rotate in the same direction, one of the frictional surfaces moves towards the apex of said wedge-like gap while the other moves in the opposite direction, i.e. away from it.

Separated fibers are supplied into the wedge-like gap by air flow in a direction substantially perpendicular to the axes of rotation of said sucking drums. The wedge-like gap is disposed in the region of stationary sucking-in ducts provided in the cavities in the interiors of the perforated sucking drums. The fibers supplied into the wedge-like gap are sucked by technological air drawn in from the ambient atmosphere, substantially into the region of apex of said gap where they are caused by the frictional surfaces to wrap onto the freshly built open end of the yarn being continuously withdrawn.

The number of twist turns imparted to the yarn depends on the transmission ratio between the diameter of yarn to be produced between the frictional surfaces of the sucking drums and the diameter of said drums. Since the yarn diameter is many times less than the diameter of the sucking drums, the respective transmission ratio is very high so that at the usual yarn take-off velocities, the peripheral velocities of the drums are relatively very small. This constitutes an advantage relative to the high speeds of the rotors of open-end spinning units.

However, the above-described prior frictional spinning system does not optimalize the effectiveness of such spinning technique. Considerable slippage occurs between the yarn being built and the sucking drums, so that in order to obtain a desired twist number it is necessary to increase many fold the number of revolutions of said drums relative to the theoretical value derived from the above-mentioned ratio between the diameter of the yarn and that of the drums.

The wedge-like gap provided in the above-described prior system between the frictional surfaces which are in contact with the open end of the yarn being built opens very abruptly and widely from the apex of said space, so that its action on the yarn rolling is insufficiently effective. Due to a slippage between the yarn and the frictional surfaces, the fibrous material is excessively heated by frictional contact heat, which causes the twist to be thermally set in the yarn. This is disadvantageous with regard to the structure of final yarn and to further processing thereof, such as the manufacture of woven fabrics. This factor is especially important when processing thermoplastic fibers.

The sucking-in ducts of the above-described prior system communicate directly with the ambient atmosphere via the perforated sucking drums. Thus to achieve a value of subatmospheric pressure necessary for retaining fibers on the drum surfaces, a considerable subatmospheric pressure has to be produced on the drum surfaces as to compensate for the action of centrifugal force. Such value of subatmospheric pressure should correspond to the theoretical condition of a high technological air throughflow connected with an increased power consumption.

Moreover the system actually comprises a dual supply of fibrous material via two sucking-in ducts, which requires an additional power input. Thus fibers are simultaneously conveyed to the wedge-like gap by the two sucking drums, so that marginal fibers carried along by the drum rotating away from the apex of the wedge-like space are brought away from the yarn building region, i.e. beyond the mouth of the sucking-in duct, whereby the fibers hurled off the frictional surface, due to the action of centrifugal force, increase the fiber fly-off waste.

Another known apparatus for frictional open-end spinning based on substantially the same principle, comprises a pair of cooperating frictional surfaces provided on revolving rotary carriers. The frictional surfaces rotate in opposite directions and form a wedge-like gap therebetween; the fiber supply zone is provided on one of them which is perforated for this purpose. The perforated frictional surface is substantially embodied as a disc, to the sucking zone of which defined by a sucking-in duct mouth disposed below the disc, there are sucked separated fibers continuously supplied by a fiber supply mechanism.

The second frictional surface is provided on a frusto-conical surface in such a way that an element line of said frusto-conical surface extends parallel to a radial line of the disc along the line of the closest approach of the two carriers.

Fibers sucked onto the disc are conveyed into the wedge-like gap. Yarn is continuously formed in this gap by the continuous wrapping of the supplied fibers onto an open end of the already produced yarn, such end rolling on the disc. The yarn is continuously withdrawn in a radial direction relative to the disc by a pair of take-off rollers and is finally wound onto a bobbin by a takeup mechanism.

The number of twist turns to be imparted to the yarn is determined in a manner similar to the preceding case, by the transmission ratio between the yarn being formed in the wedge-like gap and the two frictional surfaces.

The effect of the last-described prior system is practically the same as with the first-described prior frictional spinning apparatus; it is true that the slippage between the cooperating frictional surfaces is somewhat redued here, but it is still disadvantageous from the viewpoint of the effectiveness of the spinning process.

Finally, there is known a prior frictional spinning apparatus wherein the frictional surfaces are provided on two superposed endless belts driven in such a manner that their runs confronting each other move in opposite directions. The axes of the respective guide rolls encircled by the belts are all parallel with one another. Fibrous material is supplied onto a sucking zone provided on the upper run of the lower belt, and particularly on that part thereof which overlaps the lower run of the upper belt. The sucking zone is situated upstream and in the place where the horizontal frictional surface of the lower endless belt forms a wedge-like gap in cooperation with the frictional surface of the upper endless belt, and more particularly in the zone where the latter begins to encircle its guide roll.

Fibers fall from the fiber separating mechanism onto the lower endless belt where they are sucked by the action of technological air drawn in from the ambient atmosphere through a sucking duct, located between the runs of the lower belt, onto the frictional surface of said lower belt and conveyed to the wedge-like gap. By rolling the yarn end between the two frictional surfaces and by continuously wrapping the supplied fibers onto said end there is formed yarn which is continuously withdrawn in a direction perpendicular to the direction of movement of the belts. This apparatus has substantially the same disadvantages as those hereinabove referred to in connection with the discussion of the first two prior systems.

In spite of certain drawbacks, the afore-described frictional open-end spinning systems are substantially preferable to open-end rotor spinning systems for some types of fibrous material. The undoubted advantage of the former is the relatively low speed of the rotary elements operating, theoretically, on the basis of the transmission ratio between a small yarn diameter and relatively large diameters of the carriers on which the frictional surfaces are provided.

Although with known frictional open-end spinning systems undesirable yarn slippage occurs, such technique enables the output of these systems to be further raised because of said favorable transmission ratio.

It is an object of the present invention to provide an improved frictional open-end spinning system, and more particularly to eliminate the undesirable slippage of the yarn in the yarn building region.

The method of frictionally spinning yarn in accordance with the invention is based upon the open-end spinning principle. The method comprises depositing continuously supplied separated fibers onto a frictional surface provided on a rotary carrier and designed for conveying the fibers to the mouth of a wedge-like gap defined by said frictional surface and another frictional surface provided on another rotary carrier moving in said wedge-like gap in the opposite direction relative to the first frictional surface, twisting the fibers to yarn in the mouth of said wedge-like gap, and withdrawing the yarn sidewards from the wedge-like gap while preventing the twist propagation, the method being characterized in that the fibers are twisted between a convex and a concave frictional surface.

An essential feature of the invention is in that due to the sucking effect produced on a portion of the frictional surface, the fibers are supplied in the form of a flow of separated fibers onto said frictional surface.

To carry out the method according to the invention, an apparatus has been provided, the apparatus comprising a mechanism for supplying the separated fibers onto a frictional surface of a pair of frictional surfaces provided on respective rotary carriers and associated in contactless manner with each other so as to form a wedge-like gap in the mouth of which the fibers are twisted, due to friction with the two frictional surfaces moving in mutually opposite directions in said wedge-like gap, and a mechanism for taking off the yarn sidewards from the wedge-like gap, said yarn taking-off mechanism being adapted to prevent any twist propagation, the apparatus being characterized in that one frictional surface is concave and the other frictional surface is convex relative to the yarn building region in the mouth of the wedge-like gap. In accordance with the invention, one frictional surface is concave and the other frictional surface is convex relative to the yarn building region in the mouth of the wedge-like gap.

Substantially, one of the frictional surfaces is provided on an inner carrier received in an outer carrier on which the other frictional surface is provided.

The apparatus comprises various embodiments; thus, for instance, the two frictional surfaces may be cylindrical, or conical, or one thereof may be cylindrical and the other conical. Alternatively, the inner carrier can be embodied as an endless belt having a frictional surface, the other frictional surface being provided on a surface of revolution.

In another preferred embodiment, the inner carrier, which is provided with the perforated frictional surface is secured on a positively driven hollow shaft connected to a subatmospheric pressure source, is mounted for rotation in a stationary housing into which a duct for supplying fibers from the fiber separating device opens. The housing is provided with a longitudinal slot designed for demasking a part of the frictional surface of said inner carrier associated in a contactless manner with the other frictional surface of the outer carrier so as to form a wedge-like gap in which the perforated frictional surface of the inner carrier is moved towards the apex of said wedge-like gap.

In another preferred embodiment, the hollow shaft is mounted for rotation in a support wall provided on the housing of the fiber separating mechanism.

In another preferred embodiment the outer carrier is mounted for rotation in the cavity of a stationary casing of the spinning mechanism, which casing is frontally shieldable by the support wall in which there is provided a yarn take-off opening opposite the wedge-like gap.

It is preferred when carrying out the spinning-in process to mount the housing of the fiber separating mechanism by means of its guide portion to reciprocate on the casing of the spinning mechanism between a rear position, in which the support wall masks the cavity of said casing, and a front position, in which the housing is uncovered. The outer carrier is supported by a bearing passing through a neck of the casing of the spinning mechanism. Between the support wall and the front edge of the cylindrical portion of the spinning mechanism housing there is interposed a sealing ring, while between the support wall and the front edge of the outer carrier, a labyrinth is interposed.

For holding the yarn end during the spinning-in process, a yarn end gripper is provided on the housing in an extension of its longitudinal slot.

An advantage of the improved frictional spinning system of the invention is that it provides a high output substantially without losses due to the slippage of yarn between the two frictional surfaces. Thus the yarn is acted upon by two frictional surfaces of which one, relative to the yarn building region, is concave and the other is convex. Because of such arrangement, the wedge-like gap has a very advantageous shape for yarn rolling, since said gap widens very slowly or gently so that it minimzes yarn slippage between the frictional surfaces. In spinning, no heat fixation of the yarn twist occurs since the frictional contact temperature rise of the rolling surfaces is negligible.

In consequence of the advantageous friction ratios between the spun yarn and the frictional surfaces, the velocity of said surfaces substantially corresponds to the theoretical velocity or revolutions necessary for imparting the theoretical number of twist turns to the yarn end, the yarn slippage at required adjusted peripheral velocities of the frictional surfaces being negligible. The effectiveness of the yarn production relative to known frictional open-end spinning systems is markedly improved by this factor.

Another essential advantage of the apparatus according to the invention resides in the sealed spinning system; the technological air is caused to flow from the ambient atmosphere to the hollow cylinder through the fiber separating mechanism and the supply duct together with the fibers; this means that in order to produce a subatmospheric pressure on the perforated frictional surface necessary for retaining the fibers, only a relatively small technolgical air throughflow is needed, because of the sufficient tightness of the system.

The subatmospheric pressure produced on the perforated frictional surface to retain the fibers thereon and to overcome the centrifugal force to which the fibers are exposed can be relatively low because the cylinder velocity need not be raised in order to compensate for slippage. The inner carriage can have a relatively small diameter, thus allowing it to be received in the cavity of the outer carrier.

The energy input to establish technical air conditions in the apparatus according to the invention can be reduced to a minimum relative to the existing frictional open-end systems, which require a relative high energy input for the production of technological air. As regards the energy input, it is preferable that only one of the frictional surfaces be perforated. However, the condition of depositing the fibers onto the perforated frictional surface conveying them towards the apex of the wedge-like gap has to be complied with. Likewise, it is preferable to produce the subatmospheric pressure on the frictional surface of the smaller carrier.

In the embodiment wherein the inner carrier is an endless belt provided with the frictional surface and the second frictional surface is a surface of revolution, it is preferable that the operative subatmospheric pressure be produced on the surface of revolution only. Such embodiment is further advantageous in that it is possible to utilize the so-called self-ventilating perforation, since the fibers adhering to the frictional surface are exposed practically to the same value of centrifugal force as the force of air produced by the subatmospheric pressure, so that the consumption of technological air necessary for retaining the fibers on the perforated frictional surface is a minimum.

The fact that yarn is twisted without slippage, improves the final yarn product, which exhibits a substantially better structure than that produced by the prior art systems.

In the apparatus according to the invention it is possible to process both natural and man-made fibers as well as blends thereof, including glass, asbestos, or like fibers, also fibers within a very broad range of deniers, and irrespective of staple lengths, such as cotton, or wool type staple fibers. The apparatus is easily operated and provides for a quick and easy spinning-in process.

The thread breakage rate is minimum since the yarn is not exposed to the relatively high spinning tension which is typical for rotor spinning system. The tension of the yarn being spun depends only upon friction forces prevailing between the yarn and the frictional surfaces, and on the sucking-in force holding the fibers on the perforated frictional surface.

The process of the invention enables, in general, the production of medium and coarse yarn counts. The yarn structure resembles that of orthodox spun yarn except that the yarn surface is more highly twisted than its core. The yarn is even, and is suitable for practically all applications. From the viewpoint of yarn evenness, it is advantageous that the fibers be accumulated at random on a considerable peripheral area of the frictional surface of the inner carrier. The yarn strength is taken care of by the fact that the fibers are maintained in straight condition, in the yarn building region due to the action of the subatmospheric pressure of technological air in the air-tight system.

It has also been found that the yarn formation can be improved by providing zones of variable suction effect on the perforated surface of the inner carrier, and more particularly in the region of the wedge-like gap.

Thus it is an object of the invention to provide means for establishing an appropriate sucking effect regime on the perforated surface of the inner carrier so as to secure advantageous conditions for processing fibrous materials of various kinds, staple lengths and deniers in an open-end spinning process.

In accordance with one feature of the invention, the apparatus is characterized in that the inner carrier in the cavity of which there is produced a subatmospheric pressure manifesting itself by a sucking effect on the perforated surface of said inner carrier, a baffle member being provided in the inner carrier for localizing the sucking effect on said perforated surface. Such baffle member defines a narrow sucking effect field on the perforated surface of the inner carrier upstream of the mouth of the wedge-like gap.

In one of the preferred embodiments, the baffle member is a tubular body having an axial slot defined by a front edge and a rear edge, said edges defining a narrow sucking effect field on the perforated surface of the inner carrier upstream of the mouth of the wedge-like gap, while a wall of said tubular body, from the start of the zone of depositing fibers onto the perforated surface of the inner carrier to the front edge of said body, extends away from the inner wall of said perforated surface in such a way that the sucking effect rises on the corresponding portion of the perforated surface up to a sucking effect value which is lower than the value thereof acting in the narrow field provided upstream of the mouth of the wedge-like gap.

According to another embodiment, the baffle member is a segment adapted to bear upon the inner wall of the perforated surface on the inner carrier so that the sucking effect on said perforated surface from the mouth of the wedge-like gap is null in the direction toward the apex of said gap.

The function of the baffle member can be preferably combined with that assumed by perforations having different sizes and spacings, respectively. In one embodiment, the perforated surface of the inner carrier is divided into two transverse fields having different densities of perforations having the same diameters while the density of the first field corresponding to the fiber depositing and accumulating zone on the perforated surface of the inner carrier, successively rises up to a value which, in the second field corresponding to the yarn twisting zone proper, is constant. The perforation density in the first field can vary either in a linear or travelling wave course.

In an alternative embodiment, the perforated surface of the inner carrier is divided into two transverse fields having the same perforation spacings, while the size of perforations of the first field corresponding to the fiber depositing and accumulating zone on the perforated surface of the inner carrier successively rises up to value which, in the second field corresponding to the yarn twisting zone proper, is constant.

Some of the preferred embodiments of the present invention will be hereinafter described with reference to the accompanying schematic drawings in which:

FIG. 1 is a partially in side elevation view and partially in section of the spinning unit together with the housing of the fiber separating mechanism in its rear position;

Figure 16:
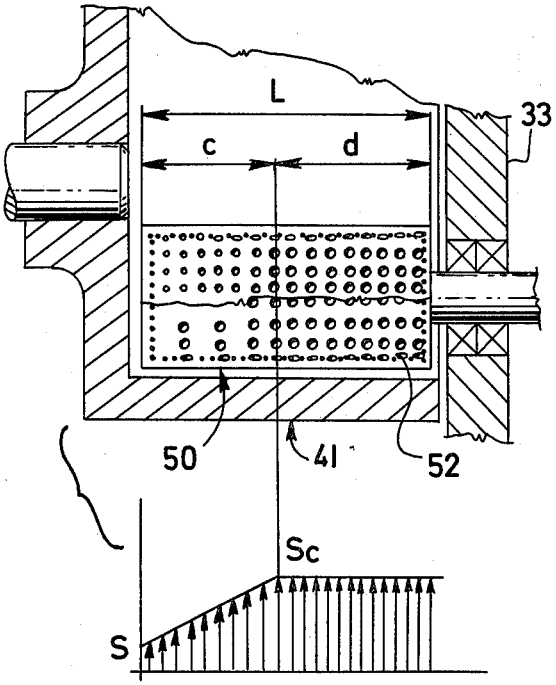
Figure 17:
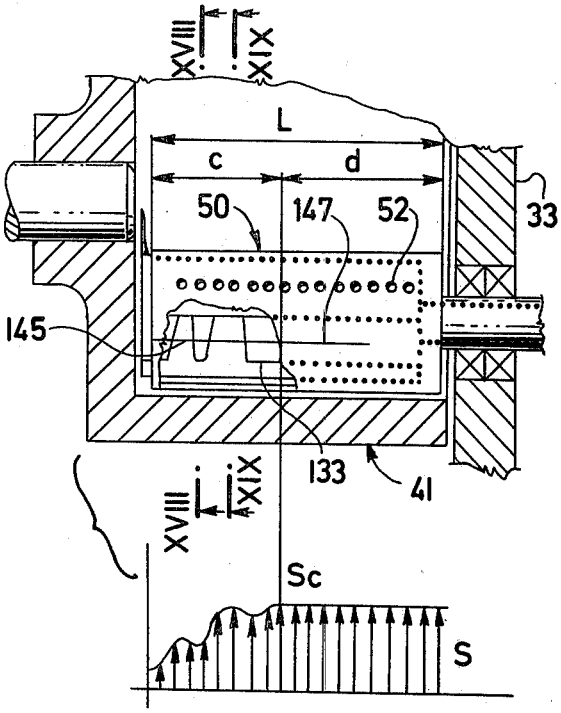
Figure 18:
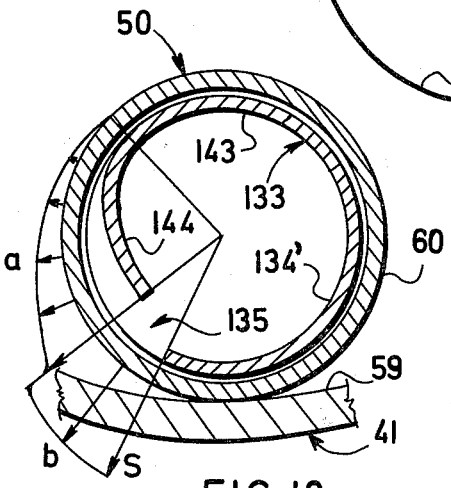
Figure 13:
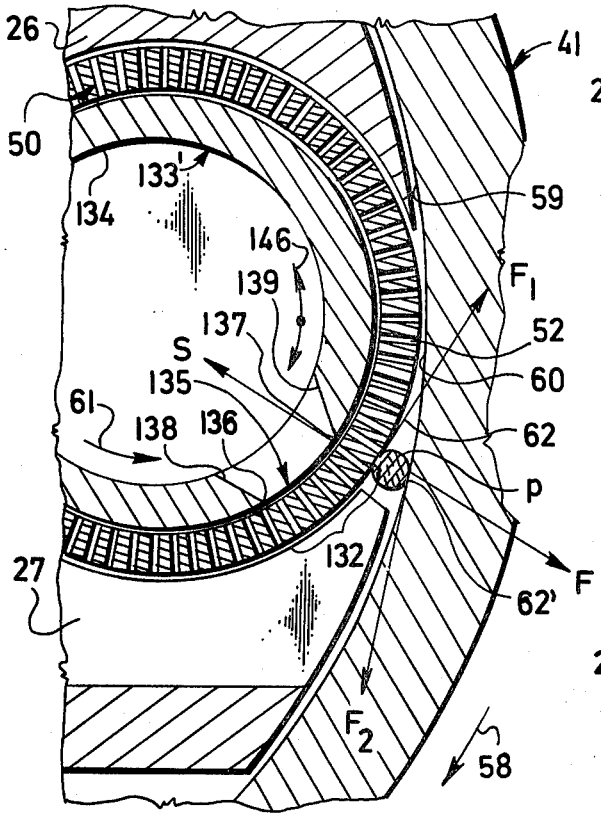
Figure 14:
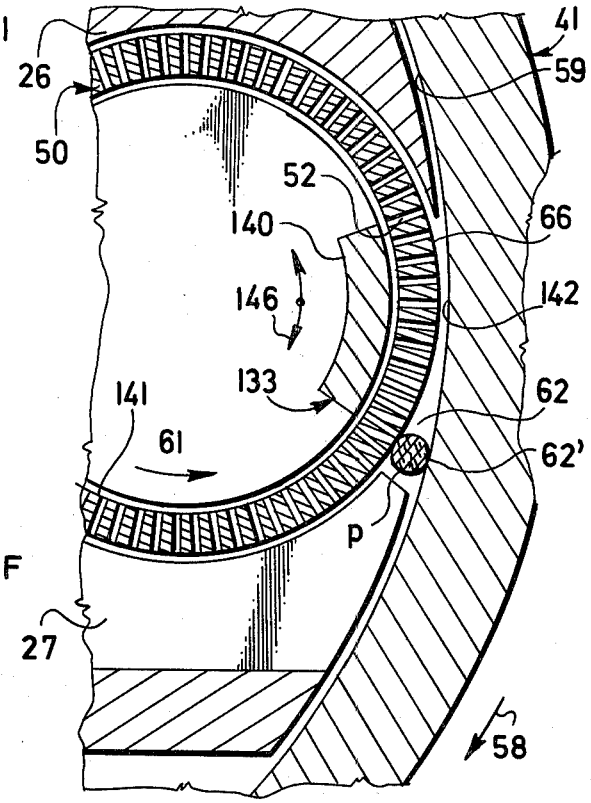
Figure 15:
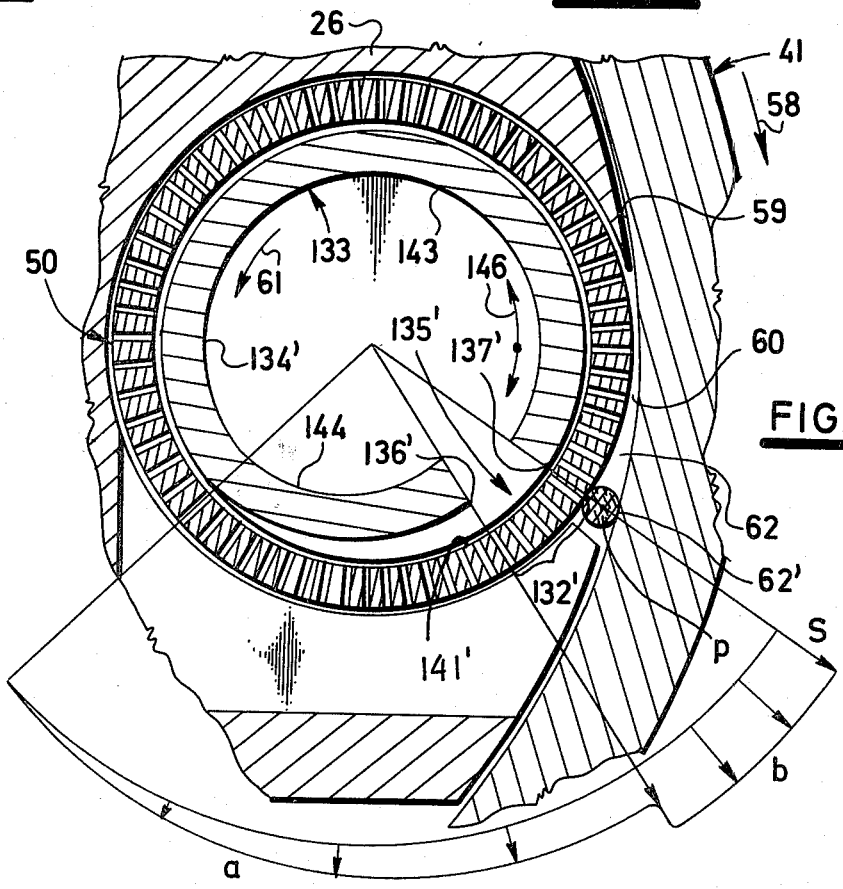

FIGS. 8 to 12, inclusive, are perspective views of spinning mechanisms provided with various alternative carrier embodiments;

FIG. 13 is an enlarged detail view in partial cross-section of the spinning unit comprising a first embodiment of a baffle member;

FIG. 14 is an enlarged detail view of a partial cross-section of the spinning unit comprising another embodiment of baffle member;

FIG. 15 is an enlarged detail view of a partial cross-section of the spinning unit comprising still another embodiment of baffle member, the view illustrating the sucking effect;

FIG. 16 is a view in side elevation of the inner carrier in which different sizes and spacings of the perforations, respectively, are shown;

FIG. 17 is a side view of the inner carrier, showing a shaped baffle member;

FIG. 18 is a sectional view taken along the line XVIII—XVIII in FIG. 17; and

Figure 19:
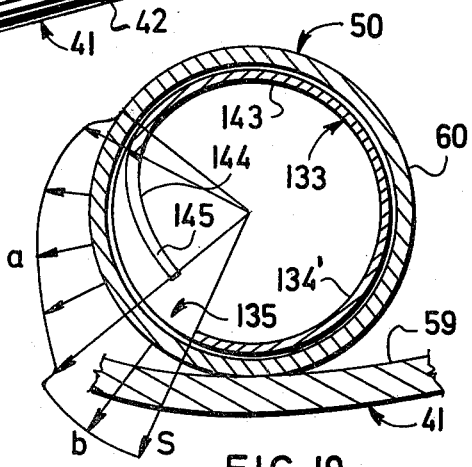

FIG. 19 is a sectional view taken along the line XIX—XIX in FIG. 17.

The illustrative spinning unit of the invention is schematically shown in FIGS. 1 through 4.

The spinning unit comprises a fiber separating mechanism 1 received in a housing 2, a spinning mechanism 3 housed in a casing 4 communicating with the housing 2, a yarn take-off mechanism 5, and a yarn takeup mechanism 6.

Figure 3:
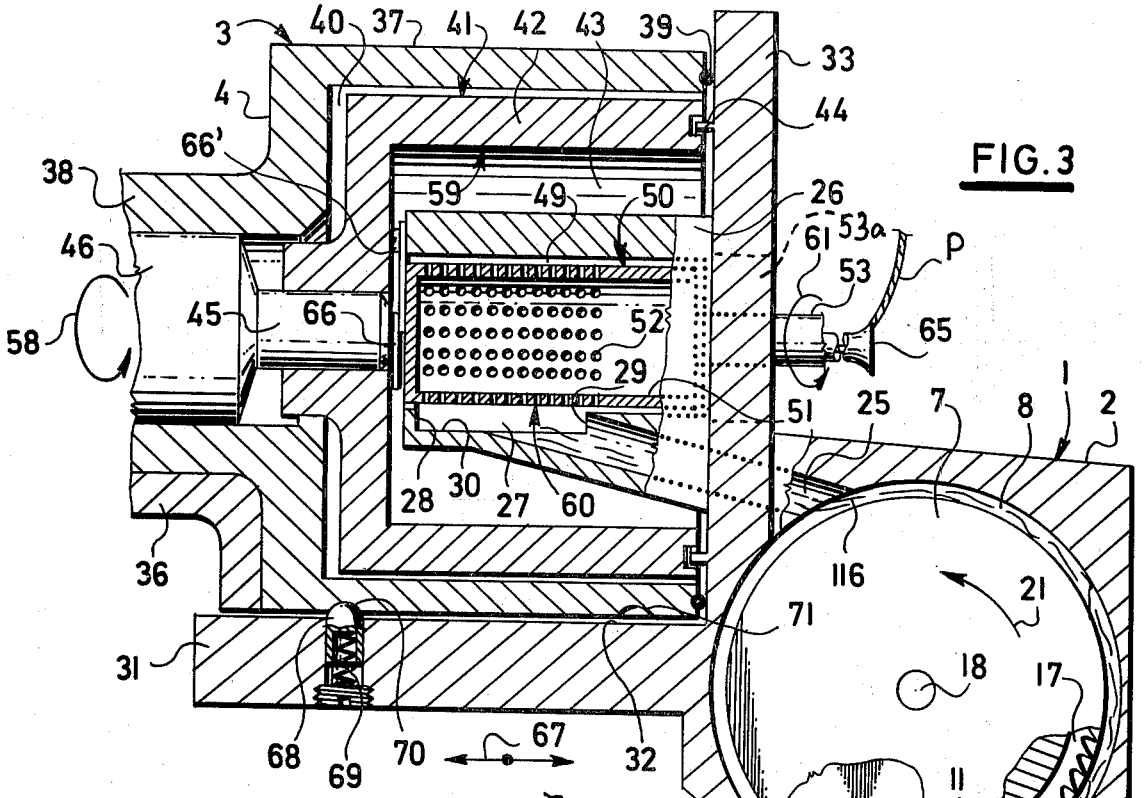
FIG. 3 is a view in section of the spinning mechanism, the section being taken along the axis of the outer carrier and perpendicular to the axis of rotation of the combing cylinder.

The operating members of the fiber separating mechanism 1, which substantially corresponds to that used in an open-end rotor spinning unit, are a combing cylinder 7 received in a recess 8 of the housing 2, and a sliver supply mechanism 9 preceding the combing cylinder 7 and received in a recess 10 of the housing 2, the recesses 8 and 10 communicating with each other via a conduit 11 (FIG. 3).

The sliver supply mechanism 9 is constituted by a positively driven knurled feed roller 12 and a thrust element 13 which is resiliently forced to said roller and which is affixed by its one end to the wall of the housing 2 by means of a screw 14. The knurled feed roller 12 and the thrust element 13 produce in cooperation a nip zone for a fibrous sliver 15 to be withdrawn from a sliver can 16 and supplied to the combing cylinder 7.

Figure 4:
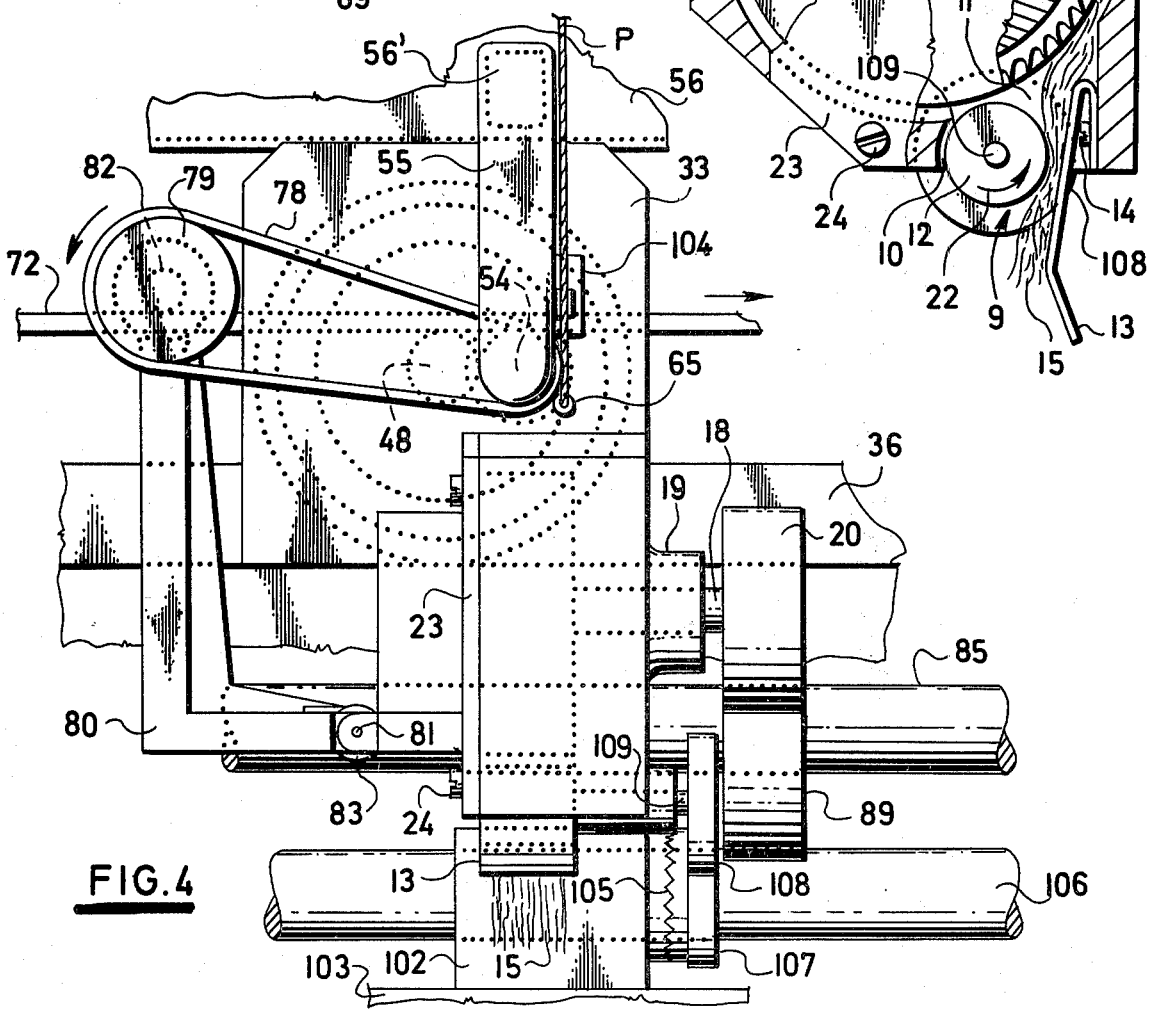
FIG. 4 is a view in front elevation of the spinning unit.

The combing cylinder 7 provided on its surface with combing elements 17 is secured on a shaft 18 mounted for rotation in a hollow boss 19 of the housing 2 and carrying at its end portion a friction roll 20 (FIG. 4). The direction of rotation of the combing cylinder 7 is indicated by arrow 21 (FIG. 3) and that of the feed roller 12 by arrow 22.

The front wall of the housing 2 in which the recesses 8 and 10 are provided is masked by a sealing cover plate 23, preferably made of transparent material and attached to the housing 2 by screws 24.

Out of the housing 2 there projects a fiber supply duct 25 which starts in the recess 8 for the combing cylinder 7, and opens in the form of a neck 27 defined by front walls 28, 29 and a bottom 30, into a stationary housing 26 fixedly connected to the body of said duct 25.

Out of the housing 2 there projects a guide portion 31 coupled by a dovetail joint 32 (FIG. 5) with the casing 4 to shift axially thereon (FIGS. 3 and 5), and a support wall 33 perpendicular to said guide portion 31. A lug 34 (FIG. 1) provided on the casing 4 is affixed by a screw 35 to the frame 36 of the spinning unit.

The casing 4 has a cylindrical portion 37 merging into a neck 38. The opposite open front side of the cylindrical portion 37 bears, via sealing rings 39, on the support wall 33. In the cylindrical cavity 40 (FIG. 3) of the casing 4 there is mounted for rotation a carrier 41 embodied, for example, as a hollow cylinder 42 the open front end of which bears, in a contactless manner, on the support wall 33. The cavity 43 of the cylinder 42 is sealed by a labyrinth 44 interposed between the facing sides of the cylinder 42 and the support wall 33 (FIG. 3).

The cylinder 42 is secured to a shaft 45 rotatably supported in a bearing 46 inserted in the neck 38 of portion 37 and locked therein by a grub screw 47 (FIG. 1). The opposite end portion of the shaft 45 carries a pulley 48.

Figure 5:
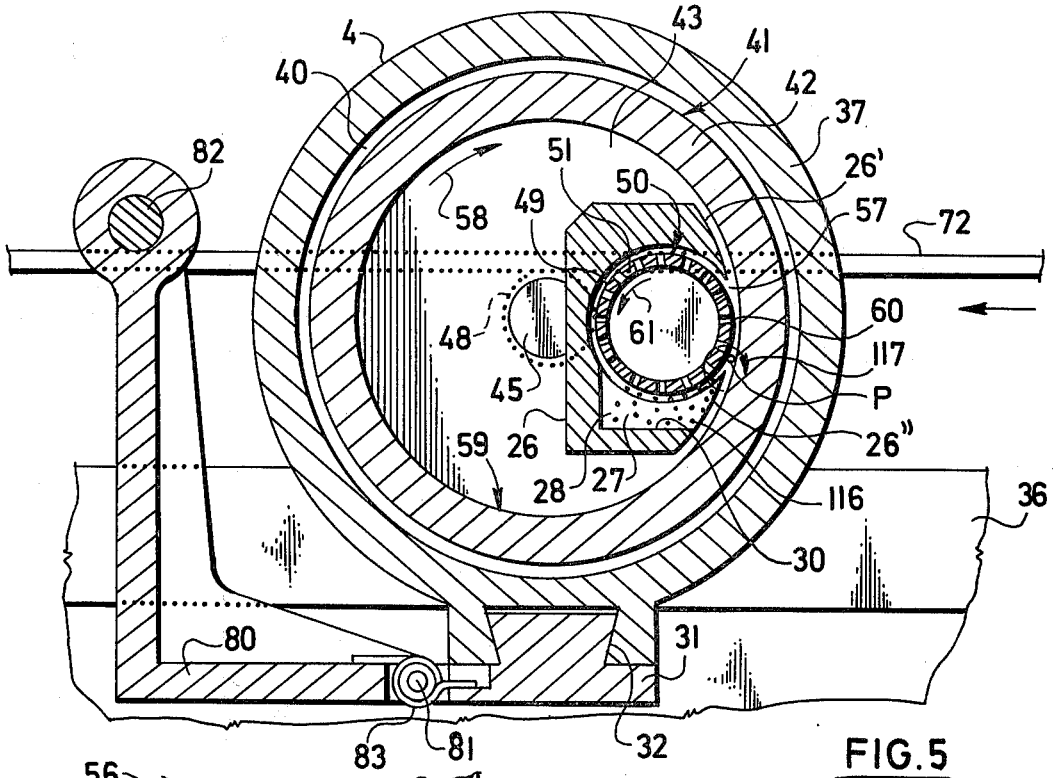
FIG. 5 is a sectional view taken along the line V—V in FIG. 1.

In a cylindrical cavity 49 of the housing 26 there is mounted for rotation a carrier generally designated 50 embodied, for instance, as a hollow cylinder 51 the peripheral surface of which is provided with perforations 52 (FIGS. 3 and 5).

The cavity of the cylinder 51 merges into a hollow shaft 53 rotatable in a bearing 53*a* provided in the support wall 33 and provided with a pulley 54. One extremity of the hollow shaft 53 is connected in a contactless manner to an air duct 55 communicating with a main air collecting pipeline 56 extending along the entire spinning machine and connected to a subatmospheric pressure source 56′ to operate the individual spinning units.

The hollow cylinder 51 is placed in close proximity, but in contactless manner, of the inner wall of the hollow cylinder 42 while the cylindrical cavity 49 of the housing 26 merges into a longitudinal slot 57 (FIG. 5) out of which a part of the hollow cylinder 51 protrudes. Walls 26′, 26″ of the housing 26 extending at either side of the longitudinal slot 57, lie as close as possible without contact to the inner wall of the hollow cylinder 42 (FIGS. 5 and 6).

The carrier 41, which is rotatable in the direction of arrow 58 (FIG. 5) is provided with a frictional surface 59. Another frictional surface 60 is constituted by the peripheral surface of the carrier 50 the rotation of which, indicated by arrow 61, is counterdirectional relative to the movement of the carrier 41.

Figure 6:
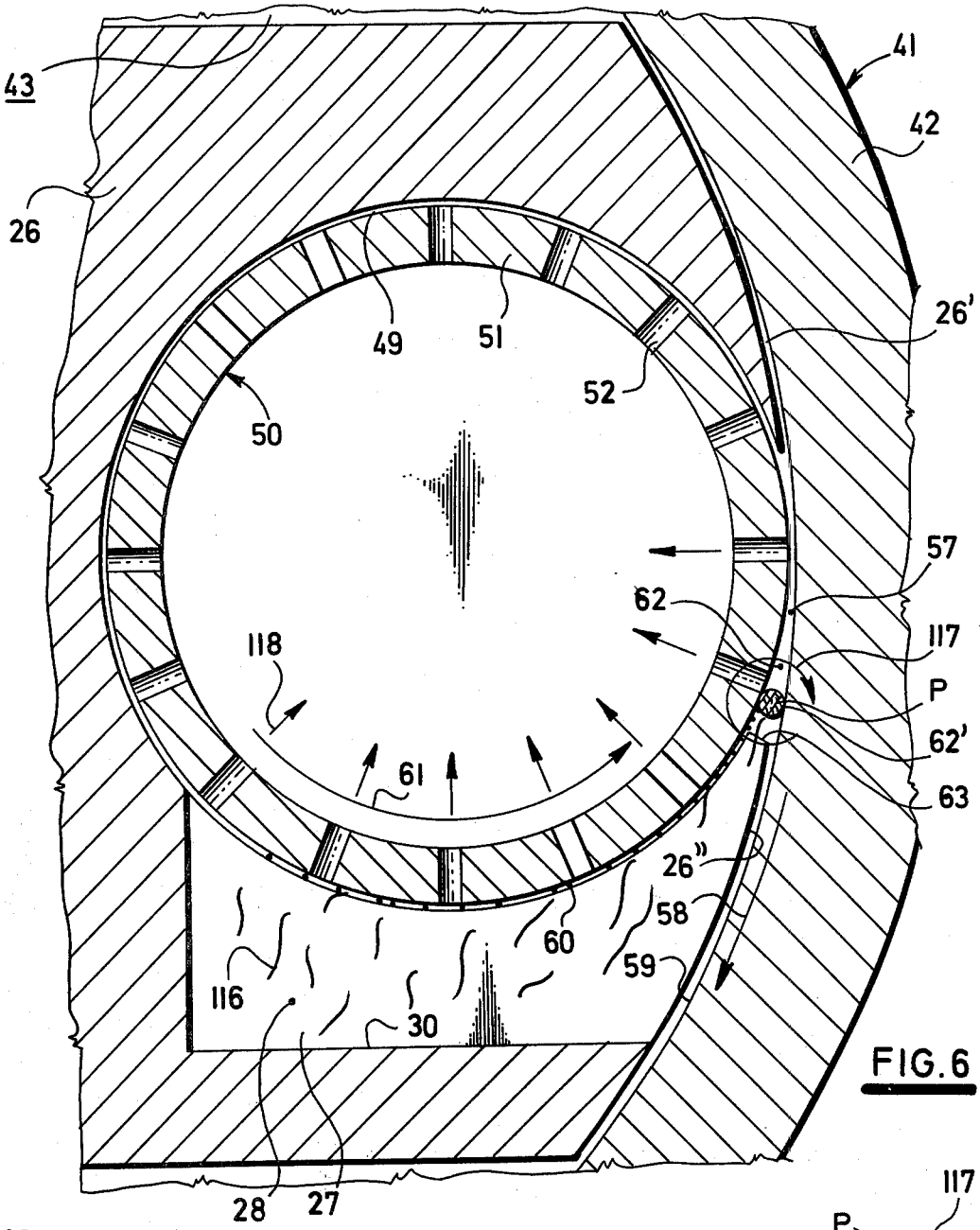
FIG. 6 is an enlarged detail view of the wedge-like gap between carriers shown in FIG. 5.

The two frictional surfaces 59 and 60 form, in cooperation with each other, at either side of the nip or region of the closest distance therebetween, wedge-like gaps (FIG. 6) of which one is designated 62; yarn P is produced in the mouth 62′ of gap 62 (FIG. 6). The position of the mouth 62′ of said wedge-like gap 62 between the frictional surfaces 59, 60 is defined by the diameter of yarn P so that it varies in dependence on the denier of yarn to be spun. The size of said mouth 62′ of the thus defined gap therefore depends upon the yarn diameter. The frictional surface 60 moves towards the apex of said wedge-like gap 62 while the frictional surface 59 moves away therefrom, said movements of the frictional surfaces 59 and 60 being necessary for the production of the yarn P.

The wall 26″ merges into the cylindrical cavity 49 as a surface 63 enlarging effectively the capacity of the yarn building wedge-like gap 62. It will be seen that with regard to the yarn producing region, the frictional surface 59 is concave and the frictional surface 60 is convex (FIGS. 5 and 6).

Figure 7:
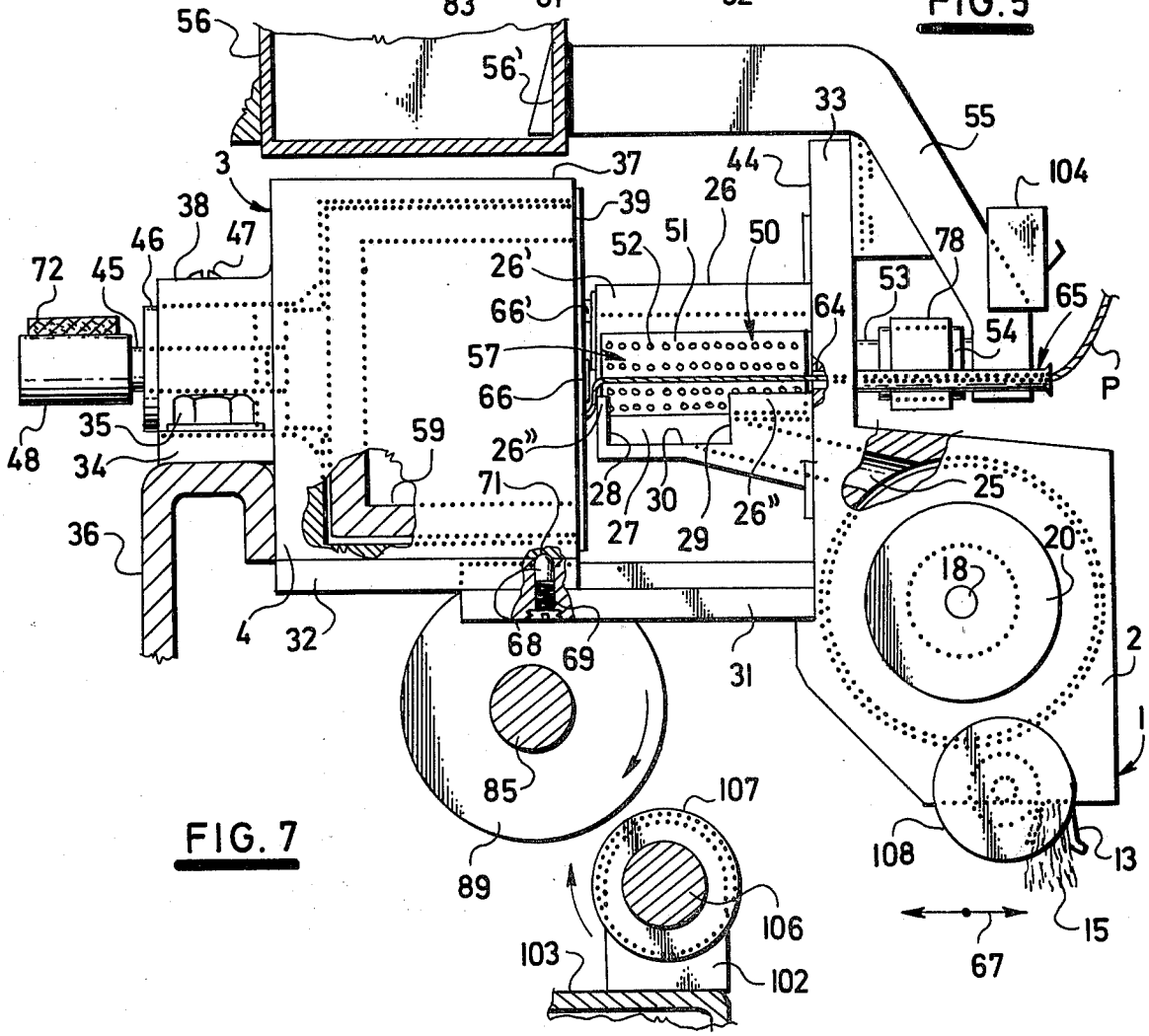
FIG. 7 is a view in side elevation of the spinning unit together with the housing of the fiber separating mechanism in its front position opposite its rear position shown in FIG. 1.

In the support wall 33, opposite the wedge-like gap 62, there is provided a yarn withdrawing opening 64 (FIG. 7) continuing as a yarn take-off tube 65 (FIG. 4). On the front surface of the housing 26 adjacent the front wall of the hollow cylinder 42 there is provided, substantially on the axis of the opening 64, a gripper 66 (FIG. 7) designed for holding the end of the yarn P during the spinning-in process. The gripper 66 is embodied, for instance, as a flat spring of which one end is affixed by a screw 66′ to the housing 26. The opposite free end of said spring resiliently bears upon the front face of the housing 26 (FIG. 7).

On principle, always one of the frictional surfaces 59 and 60 only is provided with perforation permeable by technological air. The perforation can be constituted by circular apertures, slits, or the like. Both the perforated and the unperforated frictional surfaces can be made e.g. of metal, or can be provided with a vulcanized rubber coating, or coated with a man-made material layer such as, for example, TEFLON (polytetrafluoroethylene), VULCOLLAN (highly elastic polyurethane based material), or the like.

The surface of the frictional surfaces can be glossy, smooth, but preferably mechanically worked as e.g. roughened, or provided with fine depressions, projections, or the like. Yarn P is withdrawn from the wedge-like gap 62 by the yarn take-off mechanism 5.

The housing 2 is supported to reciprocate, by its guide portion 31, in the direction of double-headed arrow 67 (FIG. 3) on the casing 4 between a rear position (FIGS. 1 and 3) in which the support wall 33 closes the cavity in the casing 4, and a front position (FIG. 7) in which the housing 26 including the gripper 66 is uncovered. In both its front and rear positions, respectively, the housing 2 is locked by a spring-loaded pin 68 received in a hole bored in the guide portion 31 (FIG. 3). The pin 68 is forced by a spring 69 against the casing 4 in which there are provided two recesses 70 and 71 defining the two respective extreme positions of the housing 2.

Figure 2:
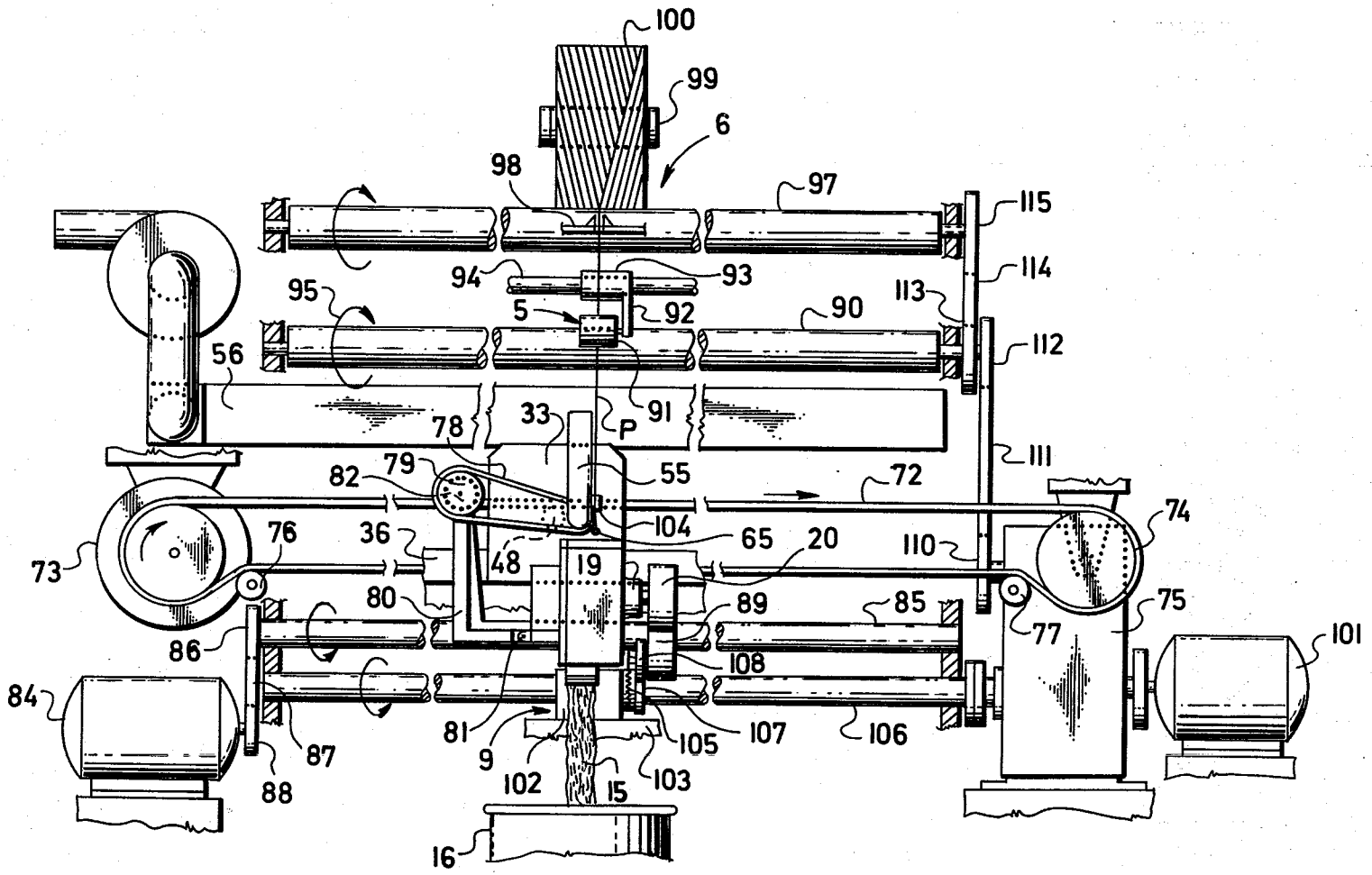
FIG. 2 is a schematic view in front elevation of the driving mechanism of the open-end spinning machine according to the present invention.

FIG. 2 schematically shows the driving means for the individual operating mechanisms of the machine which comprises a plurality of spinning units; for simplicity of illustration the figure shows only one spinning unit. Also, for simplicity, only one spinning unit is described.

The drive of the two carriers 41, 50 is derived from a main driving belt 72 encircling a driving pulley of an electric motor 73 suspended on the machine frame at one side thereof, and from a guide pulley 74 also rotatably supported on the machine frame, at the other side thereof. The main belt 72 is tensioned by two rolls 76 and 77. The pulley 48 of the outer carrier 41 is in driving engagement with the upper run of the main belt 72 (FIGS. 1 and 4).

The pulley 54 of the inner carrier 50 is driven via a belt 78 from an intermediate roll 79 arranged on an angular arm 80 pivoted by a pivot pin 81 to the support portion 31 (FIGS. 4 and 5). Another intermediate roll 82, having a smaller diameter and arranged at the other side of the roll system relative to the arm 80, is forced into frictional engagement with the main belt 72 by the action of a torsional spring 83 provided at the pivot pin 81. In the rear position of the housing 2, the intermediate roll 82 is pushed against the main belt 72 which in turn is resiliently forced against the pulley 48 of the outer carrier 41. During the displacement of the housing 2 from the rear to the front position, the operator turns the arm 80 against the force exerted by the torsional spring 83 whereby the thus released intermediate roll 82 can be displaced, during its forward movement, beyond the path of main belt 72. By disengaging the intermediate roll 82 from the main belt 72, the pulley 54, on the one hand, comes to a standstill and, on the other hand, the frictional contact between the pulley 48 and the belt 72 is interrupted by its disengagement from the main belt 72, so that the two carriers 41 and 50 then stop. After the housing 2 has been displaced into its front position, the operator again releases the arm 80 which, due to the action of the torsional spring 83, returns to the starting position.

During the displacement of the housing 2 to the rear position, the operator makes the intermediate roll 82 bear on the main belt 72 by a brief turning of the arm 80, whereby the belt 78 which drives the pulley 54 is set in motion while simultaneously the main belt 72 again comes into frictional engagement with the pulley 48 so that the two carriers 41, 50 are again in motion.

The drive of the combing cylinder 7 is derived from an electric motor 84 (FIG. 2). On a through shaft 85 supported in bearings provided in the machine frame, and driven, at a predetermined ratio with respect to the motor by a pulley 86, a belt 87 and a pulley 88 by said electric motor 84, there are secured frictional discs 89. In the rear position of the housing 2, each of said discs 89 is in engagement with the friction roll 20 secured on the shaft 18 of the combing cylinder 7 (FIGS. 1, 4). In the front position of the housing 2, the contact between the frictional disc 89 and the friction roll 20 is interrupted (FIG. 7).

The yarn take-off mechanism 5 consists of an elongated take-off roller 90 supported in bearings provided in the machine frame, and a thrust roller 91 rotatably mounted on an arm 92 which, by means of its collar 93, is mounted for rotation on a through rod 94 supported in the machine frame (not shown). The thrust roller 91 is resiliently forced against the take-off roller 90 by a torsional spring (not shown) received in said collar 93. The direction of rotation of the take-off roller 90 and that of the thrust roller 91 is indicated by respective arrows 95 and 96 (FIG. 1).

The yarn takeup mechanism 6 (FIG. 2) comprises an elongated winding roller 97 supported in bearings provided in the machine frame, an oscillating yarn guide 98 with drive means (not shown), and a partly shown holder 99 carrying a crosswound package 100. The holder 99 is tiltable into an upper position in which it is disengaged from the winding roller 97.

The drive of the sliver supply mechanism 9 and of the yarn take-off mechanism 5 is derived from an electric motor 101 (FIG. 2) via a variable speed gear-box 75.

Each spinning unit (one shown) is associated with a control unit 102 (FIGS. 2, 4) arranged on a partly shown cross-beam 103 and designed for controlling the operation of the sliver supply mechanism 9. The control unit 102 is connected via an electric line (not shown) with a thread breakage detector 104 (FIG. 4) disposed between the yarn take-off tube 65 and the yarn take-off mechanism 5. The thread breakage detector 104 also controls a light signalization system (not shown) provided on the housing 2.

A part of the control unit 102 is an electromagnetic clutch 105 deisgned for transmitting the rotational movement of a through shaft 106 supported in bearing provided in the machine frame, and coupled with the variable speed gear-box 75 via a set of gears 107, 108, onto a shaft 109 of the feed roller 12, said shaft 109 being supported in bearings provided in the housing 2.

The sliver supply mechanism 9 is switched off, i.e. the fiber supply to the combing cylinder is cut off by the detector 104 in case of thread breakage or displacement of the housing 2 from the rear position in which the gears 107, 108 are in mesh (FIG. 1), to the front position in which the gears 107, 108 are out of mesh (FIG. 7).

The variable speed gear-box 75 drives, via pulley 110, belt 111 and pulley 112 (FIG. 2), the take-off roller 90, and via pulley 113, belt 114 and pulley 115, the winding roller 97 of the yarn takeup mechanism 6.

By means of its support wall 33 and its guide portion 31, the housing 2 substantially carries the housing 26, the inner carrier 50 with its hollow shaft 53, and the air duct 55 the end portion of which is air-tightly mounted to reciprocate in the opening 56′ of the air collecting pipeline 56 (FIG. 4).

FIG. 1 shows the position of the end portion of the air duct 55 in the air collecting pipeline 56 when the housing 2 is in its rear position, while FIG. 7 shows the same in the front position of said housing 2. The rear position of the housing 2 is substantially the operative position, and the front position thereof the inoperative position.

The spinning unit of the invention operates as follows:

The sliver 15 being withdrawn from the sliver can 16 is supplied to the nip zone between the feed roller 12 and the thrust element 13 and therefrom it advances through the conduit 11 to the combing cylinder 7. The combing elements 17 of the latter comb individual fibers 116 out of the fiber beard whereupon the separated fibers are carried along by the surface of the combing cylinder 7 up to the region where the recess 8 merges into the supply duct 25. In this region, the fibers 116 are hurled by centrifugal force off the combing cylinder 7 and further on, due to their inertia and to the action of subatmospheric pressure manifesting itself by a suction effect in the supply duct 25, they are fed in substantially straight condition into the housing 26.

The technological air drawn in from the ambient atmosphere via sliver supply mechanism 9 and flowing through the supply duct 25 from the combing cylinder 7 to the perforated surface of the inner carrier 50, expands in the cylindrical cavity 49 of the housing 26 whereby its velocity decreases. Owing to the air expansion, the supplied fibers scatter within the entire space of the neck 27 and finally adhere to the perforated surface of the inner carrier 50 within the entire space confined by the front walls 28, 29 and the bottom 30. The leading ends of the fibers enter the cavity of the neck 27 and adhere to the perforated frictional surface 60 of the inner carrier 50, due to the subatmospheric pressure prevailing in the interior of said carrier 50. The thus formed fiber scattering causes the fibers to fall at random onto various areas of the frictional surface 60 while some fibers retained on this surface are covered by freshly supplied ones so that a desirable fiber agglomeration occurs. The fibers, in the form of a relatively uniform web, are conveyed by the frictional surface 60 into the mouth 62′ of the wedge-like gap 62 where they continuously wrap up onto the so-called open end of the yarn P rolling on the two frictional surfaces 59, 60, and are converted to the yarn P which is continuously withdrawn from said wedge-like gap 62 by the take-off mechanism 5, and is finally wound by the takeup mechanism 6 onto the package 100.

In case of a thread breakage, the condition is signalled by the detector 104 which simultaneously switches off, via electromagnetic clutch 105, the fiber feed to the supply mechanism 9. The operator opens the spinning mechanism by pushing the housing 2 from its rear to its front position whereby the combing cylinder 7, the feed roller 12 and the two carriers 41, 50 (FIG. 7) are disconnected from their drives. The yarn take-off and takeup mechanisms 5, 6, respectively, are always in operation.

The operator tilts off the holder 99 with the package 100 thereon into the upper position, unwinds a desired length of yarn, and introduces its end portion, as by a hook, into the take-off tube 65 and the withdrawing opening 64, and leads it over a part of the frictional surface 60 protruding through the longitudinal slot 57 of the housing 26, under the gripper 66, the yarn P being sucked onto the perforated frictional surface 60, due to the action of subatmospheric pressure of technological air.

When the spinning mechanism is open, the operator can clean the cavity of the casing 4 and the housing 26 from fiber and yarn remainders.

After the yarn P has been caught under the gripper 66, the operator pushes the housing 2 to the rear position in which the drive of the carriers 41, 50 and of the combing cylinder 7 is switched on again, except for the sliver supply mechanism 9 which has been switched off via the detector 104.

During the displacement of the housing 2 to the rear position, the operator removes the yarn from the nip zone of the yarn take-off mechanism so that the yarn P is led outside the detector 104, and re-tilts the holder 99 into the operative position. Owing to the contact of the package 100 with the winding roller 97, the tension of the yarn rises in the section between the gripper 66 and the package 100. Due to this tension, the detector 104 will operate again and sets the sliver supply mechanism 9 in operation, so that the fibers are again continuously conveyed to the combing cylinder 7.

As the tension of the yarn P rises, its end portion slips off the gripper 66 and advances on the perforated frictional surface 60 over the yarn building region while its open end, on its way to the yarn withdrawing opening 64, is twisted by the frictional surfaces 59, 60 in such a manner that the fibers continuously supplied in this region wrap up onto said open end and are twisted-in. Simultaneously, the yarn is introduced, either by hand or by means of a known inserter (not shown), into the nip zone of the yarn take-off mechanisms 5 whereupon the spinning process normally continues.

To insure the continuous yarn spinning-in process it is necessary to precisely select the length of yarn to be retained by the gripper 66, relative to the yarn take-off speed, yarn count and twist number (tpi).

After the yarn has been spun-in, the spinning process is monitored by the detector 104 up to the instant at which, for some rarely occurring reason, the yarn breaks. In such case, the detector 104 switches off the electromagnetic clutch 105 via the control unit 102, whereby the fiber supply to the combing cylinder 7 is stopped.

When remedying a thread breakage, the yarn is introduced into the gripper 66 either manually or by means of a suitable automatic spinning-in device.

When the spinning machine stops, simultaneous thread breakages in all the spinning units occur. Before restarting the machine, said simultaneous thread breakages can be remedied either one after the other by hand, which is time-consuming, or by means of a suitable mechanism for a simultaneous spinning-in process.

Automatic devices for either individual or simultaneous spinning-in are known and used in open-end rotor spinning machines so that the application thereof to the apparatus of the invention is obvious.

FIGS. 8–12 are schematic perspective views of spinning mechanisms with variously shaped carriers 41, 50 of the respective frictional surfaces 59, 60.

Figure 8:
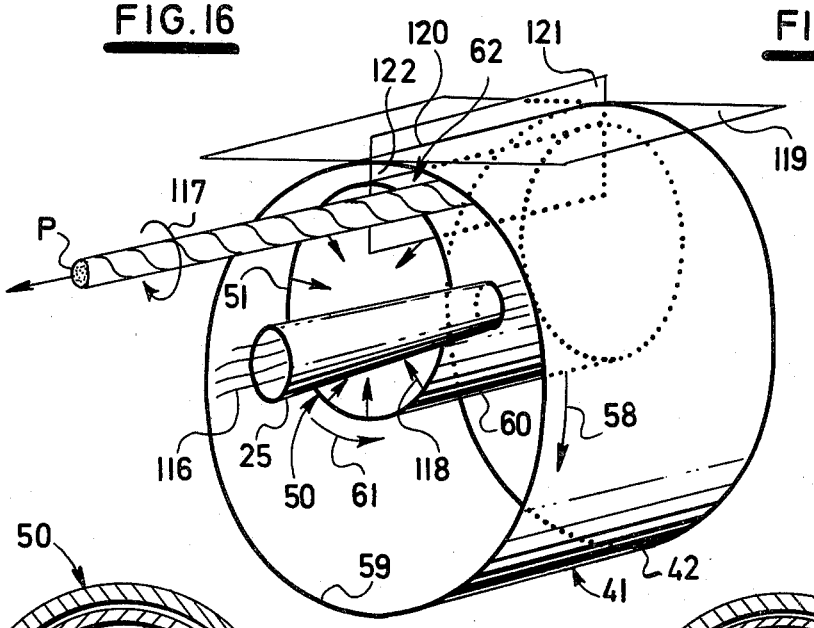

FIG. 8 is a schematic perspective view of the apparatus for carrying out the above-described process of frictional spinning according to the invention. The apparatus there schematically shown comprises the outer carrier 41 having the frictional surface 59, the inner carrier 50 having the frictional surface 60, the wedge-like gap 62 provided between said frictional surfaces 59, 60, and the supply duct 25 for supplying the fibers 116 to the perforated frictional surface 60. The yarn P being produced is twisted in the direction of arrow 117. The subatmospheric pressure produced in the cavity of the inner carrier 50 is indicated by arrows 118.

An essential feature distinguishing the apparatus of the invention from the prior art consists in that a tangential plane 119 drawn to the frictional surface 59 in an element line 120 constituting an intersecting line of the frictional surface 59 with a radial plane 121 extending through the narrowest space 122 between the frictional surfaces 59, 60, lies beyond the wedge-like gap 62. When this condition is met, any yarn slippage between said frictional surfaces 59, 60 is practically negligible.

Thus, for example, in a known apparatus having a pair of sucking drums with parallel axes of rotation, a tangential plane in an element line of the drum, which line is an intersecting line of the radial plane with the peripheral surface of the drum, said radial plane being drawn through the narrowest spacing between the frictional surfaces of the sucking drums, passes directly through the wedge-like gap.

In the first of such embodiments, depicted in FIG. 8, the frictional surfaces 59, 60 are cylindrical. The carrier 41 is embodied as the hollow cylinder 42 and the carrier 50 as the hollow cylinder 51. In this embodiment, the peripheral velocity of the frictional surfaces is the same in the entire region of the wedge-like gap 62 in which the yarn P is produced.

Figure 11:
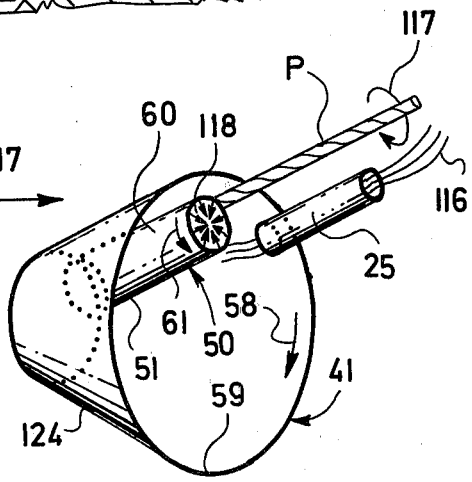

If at least one of the frictional surfaces 59 and 60 rotates at a peripheral velocity that is not the same within the entire yarn building region, there is produced yarn somewhat distinguishing from conventional yarns. Such conditions exist, for instance, in when at least one of the carriers 41, 50 of the respective frictional surfaces 59, 60 is embodied as a conical surface. Thus the course of peripheral velocity within yarn building section can be adjusted in such a manner that the peripheral velocity of at least one of the frictional surfaces 59, 60 progressively increases in the yarn withdrawal direction, i.e. in the direction of the successive yarn production (FIGS. 9, 11). The yarn produced under these conditions possesses particular properties; while the yarn core is less twisted and more bulky, the yarn surface is relatively smooth. An opposite result can be analogously achieved in that the peripheral velocity within the yarn building section decreases in the yarn withdrawal direction (FIG. 10).

In the last mentioned case the yarn surface is more bulky and hairy, whereas its core is more twisted and stronger. The two yarn types can be used for manufacturing some special textile products. A common advantage of the two above-described preferred respective embodiments is the fact that a difference in peripheral velocity of one of the frictional surfaces as compared to the other one gives rise to a favorable moment of yarn end revolution so that no slippage between the yarn and the frictional surfaces occurs.

FIG. 8 shows an embodiment comprising the carriers 41, 50, the two respective frictional surfaces 59, 60 of which are cylindrical. The outer carrier 41 is embodied as the hollow cylinder 42 and the inner carrier 50 as the hollow cylinder 51.

FIG. 9 shows an embodiment wherein the frictional surface 59 of the carrier 41 is cylindrical while the frictional surface 60 of the carrier 50 is conical. The carrier 50 is embodied in this case as a frustrum of a hollow cone 123. Subatmospheric pressure produced in the cavity of the perforated carrier 50 is indicated by arrows 118.

FIG. 10 shows an embodiment wherein both frictional surfaces 59, 60 of the carriers 41, 50, respectively, are conical. The carrier 41 is embodied as a frustrum of a hollow cone 124 and the carrier 50 as the frustrum of the hollow cone 123.

FIG. 11 shows an embodiment having the carrier 41 the frictional surface 59 of which is provided on the frustrum of the hollow cone 124, and the carrier 50 the frictional surface 60 of which is provided on the hollow cylinder 51. Subatmospheric pressure produced in the cavity of the perforated carrier 50 is indicated by arrows 118.

Figure 12:
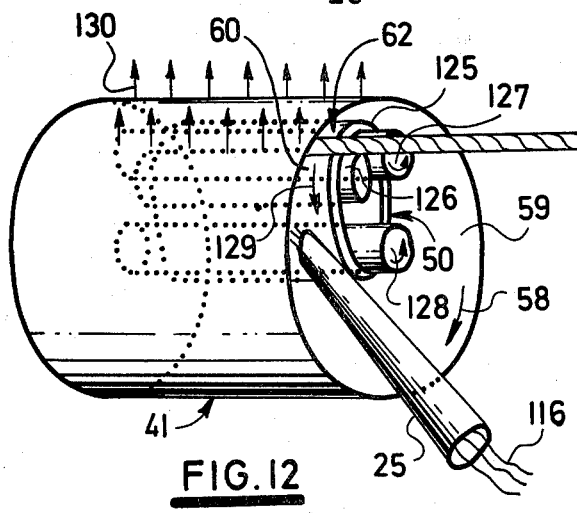

FIG. 12 shows an embodiment wherein the frictional surface 59 of the outer carrier 41 is cylindrical while the carrier 50 is embodied as an endless belt 125 on which the second frictional surface 60 is provided. The direction of movement of the endless belt 125, which is guided by a guide bar 126 and encircling two guide rolls 127, 128 of which one is positively driven, is indicated by arrow 129. The carrier 50 can be supported and driven by using any well-known means thereto, without any technical problems.

In FIG. 12, the frictional surface 59 of the carrier 50 is perforated (perforation not shown) while the frictional surface 60 of the carrier 50 is not perforated. The fibers 116 are supplied through the supply duct 25 to the perforated frictional surface 59, which in the wedge-like gap 62 is exposed to a subatmospheric pressure indicated by arrows 130. In practice, such embodiment is feasible by providing a sucking-off conduit in the wall of the housing 4 and by connecting it to a subatmospheric pressure source.

An advantage of the embodiment of FIG. 12 described above resides in a better possibility of producing various shapes of the wedge-like gap. Thus for each particular fibrous material, the shape of the wedge-like gap 62 can be optimalized so as to eliminate slippage of the yarn being built between the frictional surfaces 59, 60. The shape of the wedge-like gap 62 can be e.g. established by selecting an appropriate form of the guide bar 126 which may be made adjustable, swingable, or exchangeable.

As shown in FIGS. 8–12 that fibrous material is supplied to the cavity of the carrier 41 in a counterdirection relative to the yarn withdrawal from the wedge-like space 62; an angle included by the axis of the supply duct 25 (not shown) and the axis of the carrier 41 is acute, or at the most null. The yarn P is always taken off in the direction of element line of the two carriers 41, 50.

It is to be understood that the examplary embodiments of frictional spinning unit according to the present invention are but several of many solutions within the scope of the invention, the object of which is to optimalize the conditions for spinning yarn in a wedge-like space of the spinning mechanism without any slippage.

The essential feature of the invention resides in that fibers are twisted in the wedge-like gap by means of frictional surfaces of which one, relative to the yarn building region, is convex and the other is concave. Such essential feature can be applied to various constructional embodiments of the spinning mechanism, as indicated above. Some of the constructional solutions distinguish from one another in the embodiment of the fiber supply from the fiber separating device to one of the two frictional surfaces which twist the fibers being accumulated in the wedge-like gap to yarn which is continuously withdrawn. The wedge-like gap in the mouth of which the yarn is produced by a pair of frictional surfaces from fibers being fed by the perforated one by twisting and wrapping them onto the open end of the continuously withdrawn yarn, is embodied according to the invention in such a manner that the rotary carrier of one frictional surface is received in the rotary carrier of the other frictional surface, which construction substantially distinguishes from the prior art wherein such wedge-like space is provided between external surfaces of two rotary carriers.

As hereinbefore set forth, it has been ascertained that the formation of the spun yarn can be improved by defining suction effect zones, on the perforated surface of the inner carrier 50, and more particularly in the region of the wedge-like gap 62.

For the yarn rolling process in the mouth 62' of the wedge-like gap 62 it is preferable, and particularly if coarse yarn types are to be spun, to limit the sucking effect upstream of said mouth 62', to a narrow area 132 and thus to increase a torsional moment acting upon the yarn P in the yarn twisting zone. Such an increase in torsional moment can be attained by suppressing the yarn influencing sucking effect in the region downstream of the mouth 62' in the direction toward the apex of the wedge-like gap 62.

In the cavity of the inner carrier 50 (FIG. 13) there is received a baffle member 133 designed for defining the sucking effect on the perforated surface of said inner carrier 50. Such baffle member 133 is embodied, for example, as a tubular body 134 housed in the cavity of the inner carrier 50, a flange not shown of said body 134 being secured e.g. by screws to the lateral side of the housing 26. In said tubular body 134 which forms a part of a cylindrical surface there is provided an axial slot 135 defined by a front edge 136 and a rear edge 137 which edges define the narrow area 132 on which the sucking effect is produced (FIG. 13) on the perforated surface of the inner carrier 50, upstream of the mouth 62' of the wedge-like gap 62.

The rear edge 137 of the tubular body 134 is situated in the region corresponding, on the perforated surface, to the mouth 62' of the wedge-like gap 62. The working width of the axial slot 135 corresponds to a central angle of about 20°. Lateral walls 138, 139 of the axial slot 135 appropriately converge in the direction toward the outer surface of the tubular body 134.

FIG. 14 shows another exemplary embodiment of baffle member 133' formed as a segment body 140 bearing, in a contact-less manner, on an inner wall 141 of the perforated surface of the inner carrier 50 in such a way that the sucking effect on this area from the mouth 62' of the wedge-like gap 62 in the direction to its apex 142 is null. However, the sucking effect manifests itself in this case to its full extent within the entire portion of the perforated surface, corresponding to the mouth to the neck 27 of the housing 26, in which portion the supplied fibers are deposited and accumulated.

Further, it is preferable that the sucking effect, also in the fiber depositing and accumulating zone around the periphery of the inner carrier 50, may successively grow from the start of said fiber depositing zone up to the narrow area 132 on which the full sucking effect prevails. In this way, it is insured that even fine and short fibers are duly deposited onto the perforated surface of the inner carrier 50 so that such fibers cannot fly off through perforations 52 since in that zone of the perforated surface of the inner carrier 50 where the fibers begin to be deposited, the sucking effect is small. As a layer of fibers successively grows, due to the fiber accumulation on the perforated surface, such layer should preferably adhere more firmly to said perforated surface, due to a higher sucking effect, the fibers thus being prevented by said fiber layer from flying off.

An exemplary embodiment of baffle member 133'' serving to this purpose is shown in FIG. 15. The tubular body 134' is constituted by a wall 143 of a cylindrical surface merging into a wall 144 extending in the arcuate shape to the interior of the tubular member 134'. The axial slot 135' is defined by the front edge 136' and the rear edge 137'. From the start of the fiber depositing and accumulating zone on the perforated surface of the inner carrier 50 toward the front edge 136', the wall 144 extends away from the inner wall 141' of said perforated surface in such a way that the sucking effect in the corresponding zone of said perforated surface rises to a sucking effect value which, however, is smaller than that of the full sucking effect on the narrow area 132' formed upstream of mouth 62' of the wedge-like gap 62. FIG. 15 also shows the course of the sucking effect S on the cross-sectional area of the inner carrier 50 and the baffle member 133'' in the section a and the section b which latter corresponds to the narrow area 132 of FIG. 13.

When processing various fibrous materials differing from one another in staple length and fiber denier, it is preferable that the sucking effect along the perforated surface of the inner carrier 50 be not uniform or even, but that it rises in the yarn take-off direction.

It therefore may be advisable to increase the sucking effect along the perforated surface to a certain value which further on is to be kept constant. However, when processing some fiber types, and particularly in the case of fine fiber types, it is preferable, in order to obtain better yarn structure, to make the sucking effect grow in a wavy or variable manner. FIG. 16 schematically shows an exemplary embodiment of the inner carrier 50 designed for this purpose.

In FIG. 16, the perforated surface of the inner carrier 50 having a length L, is divided into two fields c and d having different densities of perforations 52; such perforations having the same diameters are shown in the lower broken-off part of the perforated surface of the inner carrier 50. The density of perforations 52 in the first field c, the length of which corresponds to the fiber depositing and accumulating zone on the inner carrier 50, rises evenly up to a value which, in the second field d, is constant, the length of the latter corresponding to the yarn twisting zone proper on the perforated surface of the inner carrier 50. Below the structure shown in FIG. 16, and forming a part of such figure, is a diagram showing the value of the sucking effect S on the perforated surface of the inner carrier 50 along an elementary line (not shown); a linear course of growth of the sucking effect S in the field c is clearly apparant in such diagram. The sucking effect S rises in the field c up to value $S_c$ which, in the second field d, is constant.

The same qualitative effect can be obtained, according to another alternative, by providing perforations 52 having the same spacings but different sizes; in the first field c, the size of the perforations 52 successively grows up to a value which, in the entire field d, is constant. Such perforations 52 are shown in the upper broken-off part of the perforated surface of the inner carrier 50.

FIG. 17 shows the inner carrier 50 having the baffle member 133 in the form shown in FIG. 15; such baffle member 133 enables the sucking effect S to grow in a traveling wave course. The tubular body 134' is provided in the field c with notches 145 designed for increasing the sucking effect S in the aforementioned traveling wave course.

The diagram forming a part of FIG. 17 shows quantities of the sucking effect S on the perforated surface of the inner carrier 50 acting along an elementary line 147 passing through the notches 145.

FIGS. 18 and 19 are, respectively, sectional views taken along the lines XVIII—XVIII and XIX—XIX in FIG. 17, said views being taken through the inner carrier 50 in the field c, and showing the variable course of the sucking effect S in the sections a, b of the perforated surface of the inner carrier 50, the section a being situated within the region of the wall 144 and the section b being situated within the region of the axial slot 135. For the sake of simplicity, the section lines are drawn so as not to cut the perforations.

The possibility of displacing the baffle member 133 in the direction of double-headed arrow 146 (FIGS. 13 and 14) permits an appropriate adjustment of its position for yarn P of various counts to be made. It is obvious that the zone of twisting fine yarn types is situated closer to the apex 142 of the wedge-like gap 62 than is the coarse yarn twisting zone.

In operation, the fibers having adhered due to the suction effect to the frictional surface 60 of the inner carrier 50, the carried toward the yarn formation zone where they are twisted to yarn P which, in this zone, i.e. in the mouth 62' of the wedge-like gap 62, is exposed to the action of diverse forces (FIG. 13); the frictional surface 59 acts upon the yarn P by a friction force $F_1$; the yarn portion opposite the apex of the wedge-like gap 62 is acted upon by the sucking effect S produced by subatmospheric pressure of technological air; the opposite yarn portion is no longer influenced by said sucking effect since the latter is nullified by the baffle member 133. Moreover, the radial direction extending from the inner carrier 50, the fibers being twisting to yarn are exposed to a centrifugal force F.

The fibers circumscribe a circular path along with the active surface of the inner carrier 50 from the fiber deposit line on the perforated surface thereof up to the yarn forming zone; they adhere to this surface due to the action of a sucking effect S which, in said yarn forming zone and further on, is nullified by the baffle member 133 so that centrifugal force action is allowed to fully manifest itself in that portion. Analogously, the frictional surface 59 acts upon the yarn P with a force $F_2$.

The yarn is exposed to a torsional moment which is sum of the moments of all the aforementioned forces, all the moments acting in the same direction.

The torsional moment can be expressed by the equation:

$$M=(D/2)(F_1+F_2+S+F)$$

wherein D stands for yarn diameter. Frictional spinning systems which are not provided with any baffle member for nullifying the sucking effect downstream the yarn forming zone, exhibit only a moment expressed by the equation:

$$M=(D/2)(F_1+F_2)$$

An advantage of measures for nullifying the sucking effect downstream of the yarn forming zone is also the fact that the sucking effect S can be increased, for instance, in a relatively easy manner by adjusting the subatmospheric pressure of technological air, whereby the spinning technology can be optimalized for processing various types of fibrous material.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a method of frictional spinning yarn based upon the open-end spinning principle, comprising depositing continuously supplied separated fibers onto a frictional surface provided on a rotary carrier and designed for conveying the fibers to the mouth of a wedge-like gap defined by said frictional surface and another frictional surface provided on another rotary carrier moving in said wedge-like gap in the opposite direction relative to the first frictional surface, twisting the fibers to yarn in the mouth of the said wedge-like gap, and withdrawing the yarn sidewards from the wedge-like gap while preventing the twist propagation, the improvement which comprises twisting the fibers between a convex and a concave frictional surface.

2. A method as claimed in claim 1, comprising producing a sucking effect on a portion of the frictional surface, and wherein due to the sucking effect produced on such portion of the frictional surface the fibers are supplied in the form of a flow of separated fibers onto said frictional surface.

3. In an apparatus for the frictional spinning of yarn based upon the open-end spinning principle and including a mechanism for supplying separated fibers onto a frictional surface of a pair of frictional surfaces provided on respective rotary carriers and associated in contactless manner with each other so as to form a wedge-like gap in the mouth of which the fibers are twisted due to friction with the two frictional surfaces moving in mutually opposite directions in said wedge-like gap, and a mechanism for taking off the yarn sidewards from the wedge-like gap, said yarn taking-off mechanism being adapted to prevent any twist propagation, the improvement wherein one frictional surface is concave and the other frictional surface is convex relative to the yarn building region in the mouth of the wedge-like gap.

4. An apparatus as claimed in claim 3, wherein one of the frictional surfaces is provided on an inner carrier received in an outer carrier on which the other frictional surface is provided.

5. An apparatus as claimed in claim 3, wherein the two frictional surfaces are cylindrical surfaces.

6. An apparatus as claimed in claim 3, wherein the two frictional surfaces are conical surfaces.

7. An apparatus as claimed in claim 3, wherein one of the frictional surfaces is a cylindrical surface and the other is a conical surface.

8. An apparatus as claimed in claim 4, wherein the inner carrier is an endless belt having a frictional surface while the other frictional surface is a surface of revolution.

9. An apparatus as claimed in claim 4, comprising a casing for the spinning mechanism, and wherein the inner carrier is provided with a perforated frictional surface and is secured on a positively driven hollow shaft connected to a subatmospheric pressure source, and is mounted for rotation in a stationary housing, a duct for supplying fibers from the fiber separating device into said housing, the housing being provided with a longitudinal slot for demasking a part of the frictional surface of said inner carrier, the frictional surface of said inner carrier is associated in a contactless manner with the other frictional surface of the outer carrier so as to form a wedge-like gap in which the perforated frictional surface of the inner carrier is moved towards the apex of said wedge-like gap.

10. An apparatus as claimed in claim 9, wherein the hollow shaft is mounted for rotation in a support wall provided on the housing of the fiber separating mechanism.

11. An apparatus as claimed in claim 9, comprising a support having support walls, and wherein the outer carrier is mounted for rotation in the cavity of a stationary casing of the spinning mechanism, the casing is frontally shieldable by a support wall in which a yarn take-off opening is provided opposite the wedge-like gap.

12. An apparatus as claimed in claim 9, comprising a support having support walls, and wherein the housing of the fiber separating mechanism is mounted by means of a guide portion to reciprocate on the casing of the spinning mechanism between a rear position in which a support wall masks the cavity of said casing and a front position in which the housing is uncovered.

13. An apparatus as claimed in claim 9, wherein the outer carrier is supported by a bearing passing through a neck of the casing of the spinning mechanism.

14. An apparatus as claimed in claim 9, wherein a sealing ring is interposed between the wall of the housing and the front edge of the cylindrical portion of the casing of the spinning mechanism.

15. An apparatus as claimed in claim 9, wherein a labyrinth is interposed between the wall of the housing and the front edge of the outer carrier.

16. An apparatus as claimed in claim 9, wherein a yarn end gripper is provided on the housing in alignment with the longitudinal slot in the housing.

17. An apparatus as claimed in claim 4, wherein the inner carrier is perforated and has a cavity therein in which there is produced a subatmospheric pressure manifesting itself by an inwardly directed sucking effect on the perforated surface of said inner carrier, and comprising a baffle member in the cavity in the inner carrier for localizing the sucking effect on said perforated surface.

18. An apparatus as claimed in claim 17, wherein the baffle member defines a narrow sucking effect field on the perforated surface of the inner carrier upstream of the mouth of the wedge-like gap.

19. An apparatus as claimed in claim 17, wherein the baffle member is a tubular body having an axial slot defined by a front edge and a rear edge, said front and rear edges defining a narrow sucking effect field on the perforated surface of the inner carrier upstream of the mouth of the wedge-like gap, a wall of said tubular body, from the start of the zone of depositing fibers onto the perforated surface of the inner carrier to the front edge of said tubular body, extends away from an inner wall of said perforated surface on the inner carrier in such a way that the sucking effect rises on the corresponding portion of the perforated surface up to a sucking effect value which is lower than the value thereof prevailing in the narrow field provided upstream of the mouth of the wedge-like gap.

20. An apparatus as claimed in claim 17, wherein the baffle member is a segment adapted to bear upon the inner wall of the perforated surface of the inner carrier so that the sucking effect on the perforated surface of the inner carrier, from the mouth of the wedge-like gap, is null in the direction toward the apex of said gap.

21. An apparatus as claimed in claim 17, wherein the perforated surface of the inner carrier is divided into first and second transverse fields having a different density of perforations having the same diameters, and the perforation density of the first field corresponding to the fiber depositing and accumulating zone on the perforated surface of the inner carrier successively rises up to a value which, in the second field corresponding to the yarn twisting zone proper, is constant.

22. An apparatus as claimed in claim 21, wherein the perforation density of the first field increases in a linear manner.

23. An apparatus as claimed in claim 21, wherein the perforation density of the first field increases in the manner of a traveling wave.

24. An apparatus as claimed in claim 17, wherein the perforated surface of the inner carrier is divided into first and second transverse fields having the same perforation spacings, and the size of the perforations in the first field corresponding to the fiber depositing and accumulating zone on the perforated surface of the inner carrier successively rises up to a value which in the second field corresponding to the yarn twisting zone proper, is constant.

25. An apparatus as claimed in claim 21, wherein the wall of the baffle member is provided, in the region of the first field of the perforated surface of the inner carrier with notches to raise the sucking effect on the corresponding zone of the perforated surface of the inner carrier in a traveling wave course.

26. An apparatus as claimed in claim 24, wherein the wall of the baffle member is provided, in the region of the first field of the perforated surface of the inner carrier with notches to raise the sucking effect on the corresponding zone of the perforated surface of the inner carrier in a traveling wave course.

* * * * *